US005291815A

United States Patent [19]

Reifenhauser

[11] Patent Number: 5,291,815

[45] Date of Patent: Mar. 8, 1994

[54] CUTTER

[76] Inventor: Uwe Reifenhauser, Bergstrasse 5, D-5232 Flammersfeld, Fed. Rep. of Germany

[21] Appl. No.: 991,987

[22] Filed: Dec. 17, 1992

[30] Foreign Application Priority Data

Dec. 24, 1991 [DE] Fed. Rep. of Germany ..... 4142937

[51] Int. Cl.[5] ..... B26D 1/12

[52] U.S. Cl. ..... 83/837; 83/596; 83/663

[58] Field of Search ..... 83/835, 837, 663, 595, 83/596, 356.3; 30/347; 241/292.1

[56] References Cited

U.S. PATENT DOCUMENTS

| | | | |
|---|---|---|---|
| 8,193 | 7/1851 | Lazell et al. | 83/663 |
| 4,043,238 | 8/1977 | van Ham | 83/663 |

FOREIGN PATENT DOCUMENTS

| | | | |
|---|---|---|---|
| 3833596 | 4/1990 | Fed. Rep. of Germany | 83/663 |
| 2661634 | 11/1991 | France | 83/835 |
| 0025165 | 7/1908 | Sweden | 83/835 |

*Primary Examiner*—Richard K. Seidel
*Assistant Examiner*—Allan M. Schrock
*Attorney, Agent, or Firm*—Mark T. Basseches

[57] ABSTRACT

For dividing a chunk of material which comprises areas tending to deform as well as rigid areas, a cutter with a spiral cutting edge is provided. The cutting edge has two sections of which the first in the direction of rotation, is unserrated and undergoes a relatively rapid increase of radius. The second section in the direction of rotation is serrated and follows a minimal increase of radius. With a cutter thus designed, material can be cut smoothly in the region of its deformable portion and can be sawed just as smoothly in the region of its rigid portion.

5 Claims, 1 Drawing Sheet

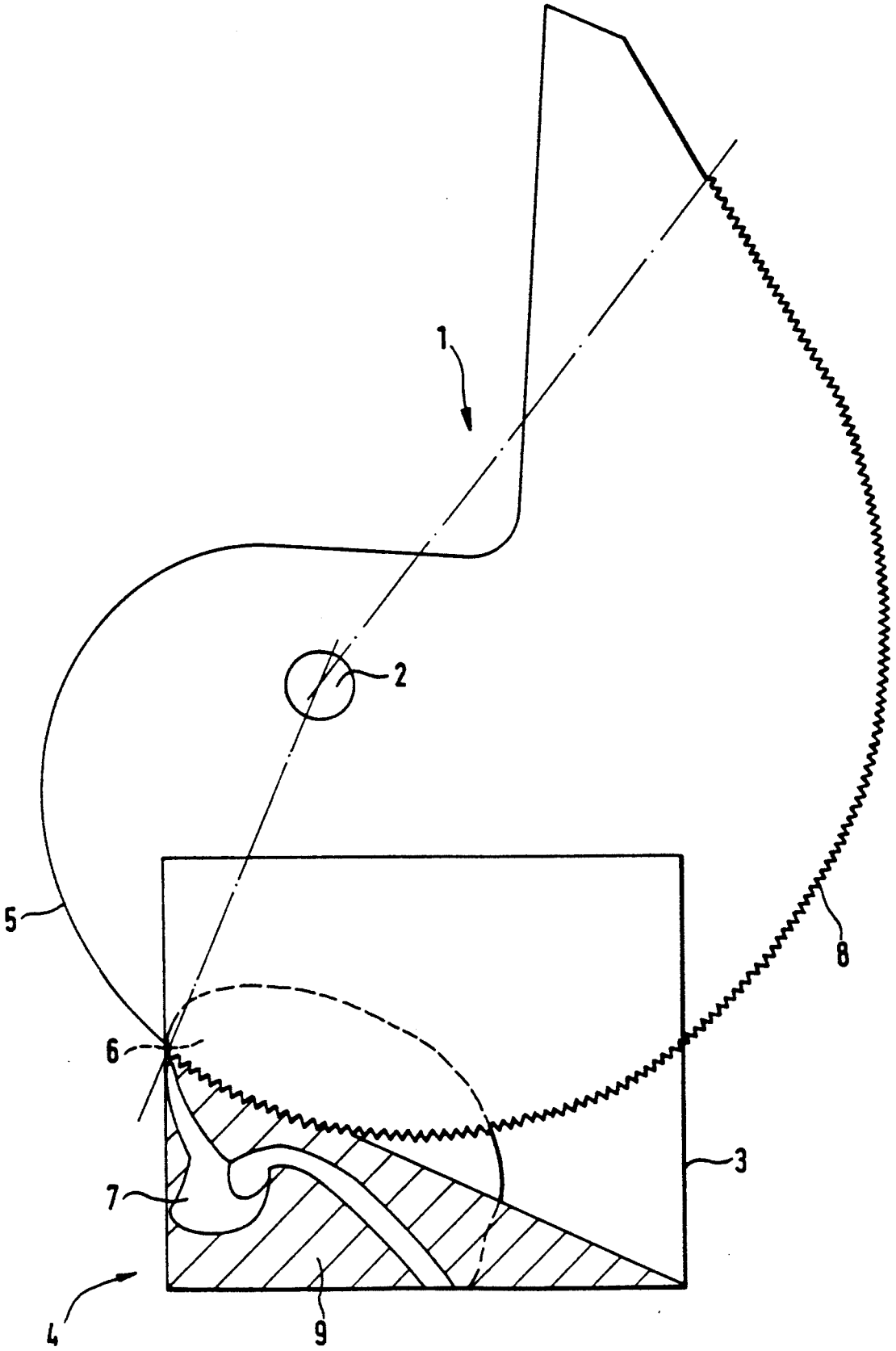
1
2
3
4
5
6
7
8
9

CUTTER

BACKGROUND AND FIELD OF THE INVENTION

This invention relates to a cutter with a spiral cutting edge extending over an angle of from 150 to 360 degrees. The cutting edge is subdivided into sections of different increase of radius.

PRIOR ART

Such a cutter, known from DE 38 33 596 C2, is used specifically for slicing material which when a certain cutting pressure is exceeded tends to undergo elastic and/or plastic deformation. The cutter is mounted on a shaft oriented perpendicular to its plane and is driven via said shaft about an axis of rotation substantially parallel to a longitudinal axis of the material being cut. The cutting edge of the known cutter is divided into three sections, the first and third sections (in the direction of rotation of the cutter) having an increase of radius which is less than that of a second cutting edge section lying between them.

With the known cutter the problem is solved of adapting the rate of advance of the currently active cutting edge section—at constant cutter speed—to the particular deformation tendency of the material to be cut. The rate of advance, therefore, is increased or reduced in inverse proportion to the deformation tendency of the material.

If a material to be sliced consists of deformable portion and a rigid portion, as for example a cutlet chunk of meat and bones, the above described known cutter is not suitable. As a rule, in fact, the cutter slices first the deformable portion, e.g. the meat of the cutlet, and thereafter less of that portion of material and more of the rigid portion of material, e.g. bone, and finally only the latter. The rigid portion is resistant to deformation as the cutter emerges, such deformation occurring primarily, for example, with boneless meat and sausage products in this cutting stage, leading to slices of irregular geometry.

SUMMARY OF THE INVENTION

It is an object of the invention to improve the initially described known cutter so that it is suitable for slicing readily deformable meats and for slicing when the material, such as a cutlet chunk, consists of readily deformable and rigid parts together for example meat and bones.

To solve the problem existing with such prior known cutter, there is provided a rotary cutter or blade having a spiral edge, said edge being defined by two sections, namely an unserrated sharp edge in leading position relative to the direction of rotation of the cutter blade followed by a serrated section. The rate of increase of the radius in the unserrated or lead section is greater than the rate of increase of the trailing serrated section.

Due to the rapid increase of radius of the first section of the cutting edge (in the direction of rotation), there need not be any concern with the deformability of the material as the cutter penetrates. This is in contrast to the cutter according to DE 38 33 596 C2, where over a first section the increase of radius is smaller. The rigid portion of the material, in fact, counteracts the actually existing deformability of the rest of the material and keeps this deformability within narrow limits due to the cohesion of the different parts. By the then following serrated section of the cutting edge being formed with minimal increase of radius, the type of cutting process and the speed thereof is optimal for the rigid portion, which is sawed apart, thereby preventing a splintering of the rigid part and simply producing an even fine-grained cut, depending on the configuration of the serration.

The slices cut from the chunk with the cutter according to the invention show a smooth cut surface over the most part of their area consisting of soft material and an equally smooth sawed surface over the most part of their area consisting of hard material.

In order to divide for example a cutlet chunk into slices and in so doing sever as large as possible an area of the meat with the unserrated section of the cutting edge and likewise as large as possible an area of the bone with the serrated section of the cutting edge, a variant of the invention proposes to extend the serrated section of the cutting edge over an angle of 80–190 degrees, preferably 165 degrees.

A cutter thus designed leads to optimal utilization of the two different cutting edge sections when used for cutlet chunks of the usual cross-sectional dimensions.

For technical as well as for economic reasons, the format of the cutter is, as a rule, kept as small as possible consistent with the intended end use. Regardless of the size of the angles over which the unserrated and the serrated section of the cutting edge extend, also the ratio of the lengths of the unserrated and serrated sections of the cutting edge varies.

For cutting cutlet chunks of the usual cross-section to cutlet pieces, it was found through tests that for a total length of the cutting edge of less than 600 mm, the length of the unserrated and of the serrated section should be approximately equal, and for a total length of the cutting edge greater than 600 mm, the length of the serrated section should be more than one half of the total length of the cutting edge. If the cutter is designed accordingly, the meat and bones are cut largely by the cutting edge section best adapted for that purpose.

It is thus clear that in a cutter of especially large size the serrated section of the cutting edge can be chosen especially large and consequently the increase of radius can be kept especially small. In a cutter thus designed, the cutting edge teeth move the bone material out of the way in the direction of rotation of the cutter as the cutter penetrates into the bone region. The required driving force of the cutter and the stress exerted thereon are accordingly low.

BRIEF DESCRIPTION OF DRAWING

An example of realization of the cutter according to the invention is shown in the drawing in a side view.

DETAILED DESCRIPTION OF DRAWING

A spiral cutter 1 is mounted on a drive shaft 2, which is disposed parallel to the length of a magazine 3. With each revolution the cutter 1 sweeps the entire cross section of the magazine 3, in which a cutlet chunk 4 is displaced axially in stepwise fashion between cuts by feed devices (not shown).

In the shown position of cutter 1, the latter's unserrated section 5 extending over 165 degrees has already passed a portion of the aperture cross-section of the magazine 3 and in so doing has cut according to its maximal increase of radius a major cross-sectional region of cutlet meat 6. The cutting edge of cutter 1 strikes a bone 7 of the cutlet chunk 4 and traverses by a serrated section 8 extending over 165 degrees the hatched cross-sectional region 9 of magazine 3 as the rotational movement continues.

In cutlet chunks 4 of normal cross-sectional dimensions, the extent of bone 7 does not exceed the hatched region 9 of magazine 3, so that the bone is cut exclusively by the serrated section 8 of the cutting edge.

The serrated section 8 of the cutting edge develops with a minimal increase of radius according to a cosine function and thus prevents, despite a high cutting power of cutter 1, an abrupt load on bone 4, so that the latter does not splinter but is sawed smoothly.

As will be apparent to skilled workers in the art familiarized with the instant disclosure, variations in details of construction may be made without departing from the spirit of the invention, which is thus to be broadly construed within the scope of the appended claims.

Having thus described the invention and illustrated its use, what is claimed as new and is desired to be secured by Letters Patent is:

1. In a rotary cutter for a meat portion which includes flesh and bone components, said cutter being adapted to be driven in a predetermined direction of rotation about an axis and having a spiral cutting edge surface, said surface being of an angular extent in the range of from about 150 to 360 degrees, said edge being divided into sections having variable increases in the rate of radial spacing of said edge from said axis, the improvement wherein said cutting edge includes a leading unserrated section adapted primarily to the cutting of said flesh components of said meat portion and a trailing serrated edge section spaced further from said axis than said unserrated surface and adapted primarily to the cutting of said bone components, the rate of increase in radial spacing of said edge of said unserrated section from said axis being greater than the rate of increase in radial spacing of the edge of said serrated section from said axis, said serrated section increasing at a rate generally in accordance with a cosine function.

2. A cutter in accordance with claim 1 wherein said serrated section of said cutting edge extends over an angle in the range of about 80 to 190 degrees.

3. A cutter in accordance with claim 2 wherein said serrated section extends over an angle of about 165 degrees.

4. A cutter in accordance with claim 1 wherein the total length of said cutting edge is less than about 600 mm and the lengths of said first and second sections are approximately equal.

5. A cutter in accordance with claim 1 wherein the total length of said cutting edge is greater than about 600 mm, and the length of said serrated section is more than one half the total length of said cutting edge.

* * * * *